US005322423A

United States Patent [19]

Heck et al.

[11] Patent Number: 5,322,423

[45] Date of Patent: Jun. 21, 1994

[54] FUEL INJECTION PUMP FOR INTERNAL COMBUSTION ENGINES

[75] Inventors: Dieter Heck, Rutesheim; Josef Guentert, Gerlingen, both of Fed. Rep. of Germany

[73] Assignee: Robert Bosch GmbH, Stuttgart, Fed. Rep. of Germany

[21] Appl. No.: 30,959

[22] Filed: Mar. 12, 1993

[30] Foreign Application Priority Data

Apr. 9, 1992 [DE] Fed. Rep. of Germany ..... 4211886

[51] Int. Cl.[5] ..... F02M 59/26

[52] U.S. Cl. ..... 417/490; 417/499; 123/503

[58] Field of Search ..... 417/490, 494, 499; 137/500, 501, 502, 503; 123/500, 503

[56] References Cited

U.S. PATENT DOCUMENTS

| | | | |
|---|---|---|---|
| Re. 20,573 | 12/1937 | L'Orange | 417/494 |
| 1,958,948 | 5/1934 | Knecht | 417/499 |
| 2,007,871 | 7/1935 | Oldham | 417/494 |
| 2,131,228 | 9/1938 | L'Orange | 417/494 |
| 3,179,053 | 4/1965 | Jordan | 417/499 |
| 3,737,258 | 6/1973 | Krauta et al. | 417/499 |
| 4,490,098 | 12/1984 | Freudenschuss et al. | 417/499 |
| 4,811,716 | 3/1989 | Guntert et al. | 123/495 |
| 5,209,208 | 5/1993 | Siebert et al. | 123/503 |

FOREIGN PATENT DOCUMENTS

| | | |
|---|---|---|
| 3314360 | 11/1983 | Fed. Rep. of Germany . |
| 395749 | 7/1933 | United Kingdom . |
| 412243 | of 1934 | United Kingdom . |
| 1472125 | 4/1977 | United Kingdom . |

*Primary Examiner*—Richard A. Bertsch
*Assistant Examiner*—Peter Konynyk
*Attorney, Agent, or Firm*—Edwin E. Greigg; Ronald E. Greigg

[57] ABSTRACT

A fuel injection pump for internal combustion engines having a pump piston driven to reciprocate by a cam drive, guided axially in a cylinder bore of a cylinder bush in which with one face end the pump piston defines a pump work chamber. The control piston has on a jacket face an oblique control edge that cooperates with a control opening in the cylinder bore. This control opening is embodied in an oval shape for the sake of a slight prepumping effect at the injection onset and a rapid opening at the end of injection, and is disposed obliquely enough in the cylinder liner so that a longitudinal axis of the oval extends approximately parallel to the oblique control edge.

5 Claims, 1 Drawing Sheet

FUEL INJECTION PUMP FOR INTERNAL COMBUSTION ENGINES

BACKGROUND OF THE INVENTION

The invention is based on a fuel injection pump for internal combustion engines as defined hereinafter. In a fuel injection pump of this type known from German Patent 33 14 360, a pump piston is moved axially back and forth in a cylinder bore by a cam drive with its end remote from the cam drive, the pump piston defines a pump work chamber in the cylinder bore of a cylinder liner that can be supplied with fuel during a portion of the pump piston stroke via a radial control opening in the cylinder liner. The pump piston is rotatable via a governor rod and on its jacket face has an oblique control edge, communicating with the pump work chamber via a longitudinal groove, and with this control edge it cooperates with the radial control opening of the cylinder liner for the sake of varying the fuel injection quantity.

The contour of the control opening is embodied such that during the diversion process, a maximally large opening cross section is made available rapidly, so that the pump work chamber and an injection valve, connected to it via an injection line and protruding into the combustion chamber of the engine to be supplied, is pressure-relieved as fast as possible, which results in a fast closure of the injection valve. To that end, the control opening is in the shape of an egg, flattened on one long side; this flattened side is oriented toward the oblique control edge of the pump piston and cooperates with it during the diversion process. In the known fuel injection pump, however, the disadvantage arises that because of the embodiment of the upper end of the control opening as a circular arc with a very large radius, which is closed at the onset of fuel injection by the end of the pump piston remote from the cam drive, a very rapid pressure rise in the pump work chamber takes place. The result is even at the onset of combustion in the combustion chamber, a large fuel quantity is injected, which combusts abruptly and thus leads to severe strain on the component and is very noisy. Accordingly, with the known fuel injection pump it is not possible to adapt both the beginning and the end of high-pressure pumping in the pump work chamber optimally to the conditions of the engine to be supplied.

OBJECT AND SUMMARY OF THE INVENTION

The fuel injection pump according to the invention has the advantage that via the oval form of the control openings, both a slow pressure rise at the onset of high-pressure pumping and a rapid pressure relief of the pump work chamber at the end of high-pressure pumping are possible. Advantageously, as defined hereinafter, the control opening is disposed so obliquely that its longitudinal axis extends approximately parallel to the oblique control edge of the pump piston In this way, as the control opening is closed by the face end of the pump piston, the original small circular radius remains operative, and this results in a less pronounced prepumping effect.

This prepumping effect arises from the slow closure of the communication between the low-pressure chamber and the pump work chamber; at the onset of the pump piston supply stroke, some of the fuel located in the pump work chamber is forced back into the low-pressure chamber, via the still-open cross section of the control opening This diversion process, in which the pressure in the pump work chamber does not increase substantially, persists until such time as the opening cross section at the control opening is closed or nearly closed, which initiates the onset of high-pressure pumping. The course of the closure of the control opening by the face end of the pump piston gains major significance. If the control opening is closed very quickly, as is the case if the course of the upper control edge of the control opening is nearly parallel to the control edge of the pump piston, the pressure in the pump work chamber builds up rapidly, the fuel rapidly attains injection pressure, and a large fuel quantity immediately reaches injection.

By comparison, a circular course, for instance, of the upper control edge, on being overtaken by the horizontal control edge of the pump piston, brings about a slow closure of the opening cross section at the control opening. As a result, the quantity of fuel flowing out of the pump work chamber is gradually reduced, and as a consequence the pressure in the pump work chamber increases slowly, so that the injection pressure is reached slowly as well and the injection valve opens in a delayed manner. At the onset of high-pressure pumping, via the injection valve opening cross section which at the onset is not completely open, initially only a small injection quantity attains injection into the combustion chamber of the engine to be supplied; this small quantity is then followed shortly thereafter by the full injection quantity, once the injection valve opening cross section is fully open.

This small preinjection quantity at the onset of high-pressure injection has an advantage that complete preparation of this quantity can be done in the combustion chamber so that at the onset of combustion in the combustion chamber a small fuel quantity combusts initially, and then as combustion continues this quantity increases, thus effecting a gradual pressure rise in the engine combustion chamber.

The prepumping effect described makes itself felt especially at low rpm, because of the inertia of the fuel, while at higher rpm the relatively small opening cross section during closure acts as a throttle shortly before the onset of the complete closure of the control opening, so that the pumping rate and hence the speed of the increase of pressure in the high-pressure region in this rpm range increases with the speed of closure of the control opening by the pump piston control edge.

During the diversion process, the long radius of the flat side of the oval control bore becomes operative; as the oblique control edge of the pump piston overtakes it, a large opening cross section is uncovered quickly. The oval shape of the long side of the control opening has the advantage, compared with a straight edge, that production tolerances in terms of the parallelism of the control edge at the pump piston and of the edge cooperating with it of the control opening has no significant influence on the accuracy of diversion at the end of the high-pressure pumping. As a result of the variation of the location and dimensioning of the control openings, it is possible to meet various demands made of the control openings. Advantageously, as defined hereinafter, by means of a location of the control opening in which its longitudinal axis is axially parallel to the pump piston axis, it is possible to attain a pronounced prepumping and postpumping effect; the postpumping effect here is attained in that the diversion cross section, at the end of high-pressure pumping, is uncovered not abruptly, but rather in a delayed manner, so that the injection valve is not abruptly pressure-relieved and consequently closes slowly, and a small fuel quantity is injected even after the actual end of the high-pressure pumping.

If, in a fuel injection pump that regulates the preinjection via a pump element or a split element, the prepumping effect is to be avoided by the control opening, then it is advantageous as provided hereinafter to dispose the oval control opening in such a way that its longitudinal axis is at right angles to the pump piston axis. In this way, the preinjection toward the pump element is reinforced by the very large radius of the control opening during closure of this control opening.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
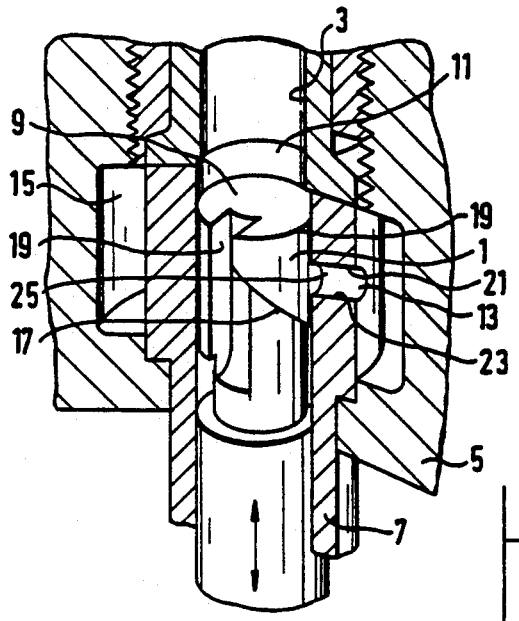
FIG. 1 shows a detail of a known fuel injection pump, in longitudinal section.

In the fuel injection pump, shown in FIG. 1 only in its portions essential to the invention, a pump piston 1 is moved axially back and forth by a cam drive, not shown, in a cylinder bore 3 of a cylinder liner 7 inserted into a pump housing 5. The pump piston 1, with its face end 9 remote from the cam drive, defines a pump work chamber 11 in the cylinder bore 3, which communicates during a portion of the piston stroke, through a radial control opening 13, with a fuel-filled low-pressure chamber 15 surrounding the cylinder liner 7 For the sake of controlling the injection quantity, the pump piston 1 is rotatable via a governor rod, also not shown, and on its jacket face it has a control recess, which cooperates with the control opening 13 and is defined by an oblique control edge 17 and communicates continuously with the pump work chamber 11 via a longitudinal groove 19.

The fuel injection pump shown functions in a known manner, in that the fuel, during the intake stroke of the pump piston 1, flows in the direction of bottom dead center via the control opening 13 out of the low-pressure chamber 15 into the pump work chamber 11. In the ensuing pumping stroke, the pump piston 1, with its face end 9, closes the control opening 13; the boundary edge between the end and the jacket face of the pump piston 1 forms a control edge 19, which when it overtakes the upper edge 21 of the control opening 13 initiates the high-pressure fuel pumping. The fuel located in the pump work chamber 11 is compressed in the course of the further piston stroke, reaches injection pressure, and via an injection line, not shown, and an injection valve it is injected into the combustion chamber of the engine to be supplied. As the oblique control edge 17 overtakes the lower edge 23 of the control opening 13, the communication between the pump work chamber 11, which is at high pressure, and the low-pressure chamber 15 is opened, so that the high pressure in the pump work chamber 1 decreases, and the fuel flows out into the low-pressure chamber 15. The pressure in the injection system drops back below the necessary injection pressure, and the injection valve closes. The instant of this opening of a control opening 13 by the oblique control edge 17 and hence the injected fuel quantity are controllable by rotating the pump piston 1. During the pumping stroke, described, of the fuel injection pump, the opening contour formed by the control opening 13 gains major significance in the cylinder bore 3, because both the injection onset and the end of injection are controlled by the overtaking on the part of the control edges 19, 17 of the piston, of the upper and lower edges 21, 23 of the control opening 13.

Figure 2:
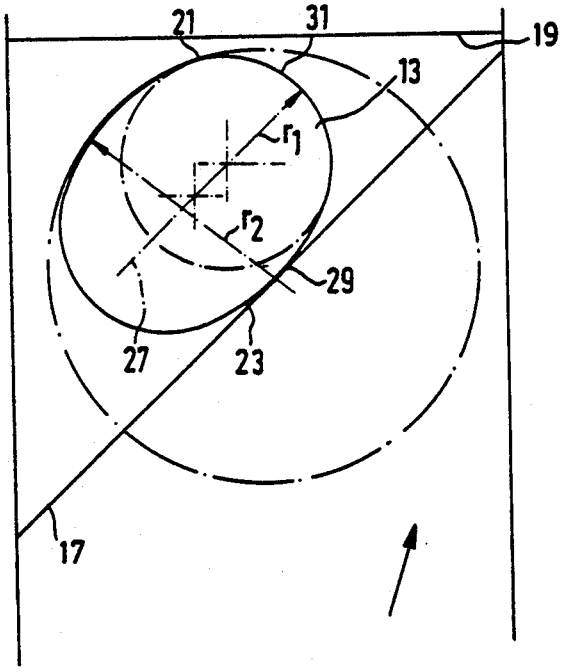
FIG. 2 shows a first exemplary embodiment of the form of the control opening according to the invention, in which this opening is disposed obliquely.
Figure 3:
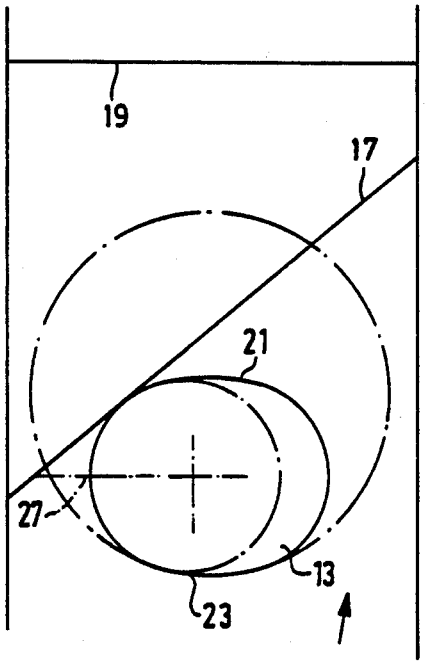
FIG. 3 shows a second exemplary embodiment of the control opening in which it is disposed horizontally.
Figure 4:
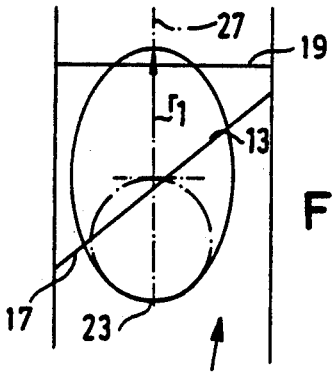
FIG. 4 shows a third exemplary embodiment of the form of the control opening, in which it is disposed longitudinally to the pump piston axis.

In order to achieve various injection courses, the form of the control opening 13 is embodied, according to the invention, as shown in FIGS. 2–4. FIG. 2 shows an oval shape of the control opening 13, in which the long radius r2 of the flat longitudinal sides 29 is made approximately twice as long as the short radius r1, of the virtually circular transverse sides 31. The control opening 13 has a longitudinal axis 27 that intersects the transverse sides 31 and that in FIG. 2 extends approximately parallel to the inclination of the oblique control edge 17. With this embodiment of the shape of the control opening 13, it is accordingly possible, compared with known circular control openings, to achieve both a slow pressure rise in the pump work chamber 11, effected by the circular course of the upper control edge 21 in the vicinity of the transverse sides 31, and a very long temporal opening cross section [this means at a long time window] at the end of fuel injection, where the oblique control edge 17 is in coincidence with the lower edge 23 having the long defining radius r2. As a result, a slight prepumping effect, with its positive effects on the combustion process can be combined with a rapid pressure relief of the high-pressure chamber at the end of the injection, similar to what is known as a "rapid spill", which results in a rapid closure of the injection valve. The prepumping effect, as already described, is achieved by the slow closure of the control opening 13, which results from the overtaking of the circular upper edge 21 by the horizontal control edge 19 of the pump piston 1, while the rapid pressure relief is brought about by the rapid opening over time of a large cross section of coincidence between the oblique control edge 17 an the lower control edge 23, extending virtually parallel to it, of the control opening 13.

The contour of the control opening 13 shown in FIG. 3 differs from that described for FIG. 2 only in the location of the control opening 13 in the cylinder liner 7. Here, the oval control opening 13 is disposed transversely; that is, its longitudinal axis 27 extends at right angles to the pump piston axis. This has the advantage that as a result of the virtually horizontal embodiment of the upper edge 21 of the control opening 13, a rapid closure at the onset of the high-pressure pumping is assured, as is required, for example in the case of provisions carried out by the element for prepumping and hence for preinjection, in which the preinjected fuel quantity is controlled via recesses on the pump piston 1 and in the cylinder bore 3. The diversion is effected similarly to the manner described in FIG. 2, by means of a rapid opening of the control opening 13 by the larger temporal opening cross section, compared with the circular-arc form of the control opening 13, because of the long radius r2 of the lower edge 23 of the control opening 13.

In the third exemplary embodiment shown in FIG. 4, the oval control opening 13 is longitudinally disposed; that is, its longitudinal axis 27 extends axially parallel to the pump piston axis. Here, a major prepumping and postpumping effect is intentionally attained; via the embodiment of the short radii r1 and the filling of the pump work chamber 11 and via the pressure decrease at the end of pumping, optimal adaptation to the requirements of the engine to be supplied is possible.

With the variant embodiments of control openings described in conjunction with FIGS. 2–4, it is accordingly possible to meet the most various demands in terms of the function of the control opening during its closure and opening, and these contours remain readily feasible from a production standpoint.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having a pump piston (1), driven to reciprocate by a cam drive and rotatable for the sake of varying the fuel injection quantity, the piston being axially guided in a cylinder bore (3) of a cylinder liner (7), with one face end (9) defining a pump work chamber (11), which is supplied with fuel via a radially extending oval control opening (13) in the wall of the cylinder bore (3), said oval control opening (13) cooperates with an oblique control edge (17) on the pump piston (1) to terminate the fuel injection, the contour (25) of the outlet face of the radial oval control opening (13) in the wall of the cylinder liner (7) is embodied as non-circular in cross-section.

2. A fuel injection pump as defined by claim 1, in which the oval non-circular control opening (13) is disposed obliquely enough so that is longitudinal axis (27) extends parallel to the oblique control edge (17) on the pump piston (1).

3. A fuel injection pump as defined by claim 1, in which the oval non-circular control opening includes a long radius (r2) in which flat longitudinal sides (29) of the oval control opening (13) is embodied as approximately twice as long as a short radius (r1) of the round transverse sides (31) that intersect the longitudinal axis (27).

4. A fuel injection pump as defined by claim 1, in which a longitudinal axis (27) of the oval control opening (13) extends axially parallel to the pump piston axis.

5. A fuel injection pump as defined by claim 1, in which a longitudinal axis (27) of the oval control opening (13) extends right angles to the pump piston axis.

* * * * *